US005887505A

United States Patent [19]

Mathian

[11] Patent Number: 5,887,505

[45] Date of Patent: Mar. 30, 1999

[54] OFFICE GUILLOTINE FOR CUTTING TABS

[76] Inventor: Louis P. Mathian, 27 rue de la Maritelle, 38320 Bresson, France

[21] Appl. No.: 773,855

[22] Filed: Dec. 27, 1996

[30] Foreign Application Priority Data

Jan. 10, 1996 [FR] France ..... 96 00390

[51] Int. Cl.[6] ..... B26D 7/01

[52] U.S. Cl. ..... 83/468.7; 83/522.19; 83/607; 83/693; 83/698.21

[58] Field of Search ..... 83/468, 468.7, 83/605, 607, 698.21, 693, 522.17, 522.18, 522.19

[56] References Cited

U.S. PATENT DOCUMENTS

| | | | |
|---|---|---|---|
| 1,172,127 | 2/1916 | Fritch | 83/468 X |
| 1,954,237 | 4/1934 | Bosworth | 83/468 |
| 2,255,812 | 9/1941 | Rickman | 83/607 X |
| 2,279,078 | 4/1942 | Swanson | 83/607 X |
| 2,559,088 | 7/1951 | Pierce | 83/468 X |
| 2,836,242 | 5/1958 | Ervin | 83/468 X |
| 3,082,799 | 3/1963 | Kennedy | 83/438 |
| 3,782,166 | 1/1974 | Whistler, Jr. et al. | 83/698.21 X |
| 5,178,051 | 1/1993 | Smith et al. | 83/698.21 X |
| 5,458,171 | 10/1995 | Ward | 83/468 X |

FOREIGN PATENT DOCUMENTS

| | | | |
|---|---|---|---|
| 0 236 766 | 2/1987 | European Pat. Off. . | |
| 355673 A1 | 2/1990 | European Pat. Off. | 83/698.21 |
| 0 491 633 A1 | 12/1991 | European Pat. Off. . | |
| 454 571 | 1/1928 | France . | |
| 241666 | 3/1946 | Switzerland | 83/607 |

*Primary Examiner*—M. Rachuba
*Assistant Examiner*—Charles Goodman
*Attorney, Agent, or Firm*—Parkhurst & Wendel

[57] ABSTRACT

An office guillotine, for making tabs on documents or intercalated sheets, includes a knife-blade articulated on a frame and having a curved opposite end to cut strips of a length smaller than that of the sheet thus creating a tab. The length of these strips is determined by the position of the sheet with respect to the knife-blade and correct positioning of the sheet is facilitated by a marking system. The markers include holes disposed on different lines each corresponding to a series of tabs. Pins are inserted successively in the different holes of any one line to achieve the corresponding series of tabs.

7 Claims, 6 Drawing Sheets

OFFICE GUILLOTINE FOR CUTTING TABS

BACKGROUND OF THE INVENTION

The invention relates to an office guillotine having a frame able to be placed on a table, said frame comprising a plate for supporting one or more sheets of paper to be cut, a knife-blade one of whose ends is pivotally mounted on said frame in such a way as to move in a plane perpendicular to said plate, and cooperating with a counter-blade to cut the sheet placed on the plate, said knife-blade and counter-blade having curved ends for cutting a strip leaving a tab of a length determined by the relative position of the sheet with respect to said curved ends.

European Patent No. 0,491,633, to which the reader should advantageously refer for manufacturing details and for understanding how the equipment operates, describes a guillotine enabling tabs of different lengths to be cut by moving the knife-blade with respect to the plate supporting the sheet of paper to be cut. This guillotine is a commercial success, but it is relatively costly for a piece of office equipment.

SUMMARY OF THE INVENTION

The object of the present invention is to achieve a simplified piece of equipment which nevertheless preserves all the possibilities of use.

The guillotine according to the present invention is characterized in that a plate has associated to it a marking system, designed to cooperate with the edge of the sheet to be cut to position the latter correctly on the plate at different predetermined locations corresponding to cuttings of tabs of different lengths. The system is arranged to make it easy for an operator on the one hand to choose the successive cutting locations necessary to achieve a series of regularly spaced tabs, notably according to the number of chapters of a brochure, and on the other hand to choose from different series of tabs.

The knife-blade is articulated on a fixed spindle borne by the frame and the tabs of different lengths are obtained by placing the sheet in different positions on the plate. The marking system of these positions, according to the invention, reduces significantly positioning errors while at the same time keeping the equipment easy to use.

The successive cutting locations are advantageously materialized on lines of markings traced on the plate, each line corresponding to a predetermined series of tabs. These lines are located side by side, parallel to the knife-blade, and the cutting locations preferably comprise holes made in the plate and pins inserted in these holes to form stops cooperating with the edge of the sheet to be cut.

The user determines the number of tabs required, which corresponds for example to the number of paragraphs of a brochure, and chooses the line of markings corresponding to this series of tabs. He then places the stop-pin successively in the different holes of this series to cut the sheets accordingly. The pin advantageously bears a magnet which keeps it pressed on the plate and the locations of the different lines are numbered.

According to an alternative embodiment of the invention the cutting locations are determined by a movable marker, whose position is controlled by a microprocessor. This marker is formed by a stop protruding out above the plate to cooperate with the edge of the sheet to be cut and this stop is moved in translation in a direction parallel to the knife-blade by a screw and nut mechanism, controlled by the microprocessor, the latter calculating the value of movement of the stop according to the series of tabs selected by the operator. Control by the microprocessor, and also the nut and bolt mechanism, are advantageously of the type described in the above-mentioned European Patent.

BRIEF DESCRIPTION OF THE DRAWINGS

Other advantages and features will become more clearly apparent from the following description of two illustrative embodiments of the invention given as non-restrictive examples only and represented in the accompanying drawings, in which.

DETAILED DESCRIPTION OF THE PREFERRED EMBODIMENT

Figure 1:
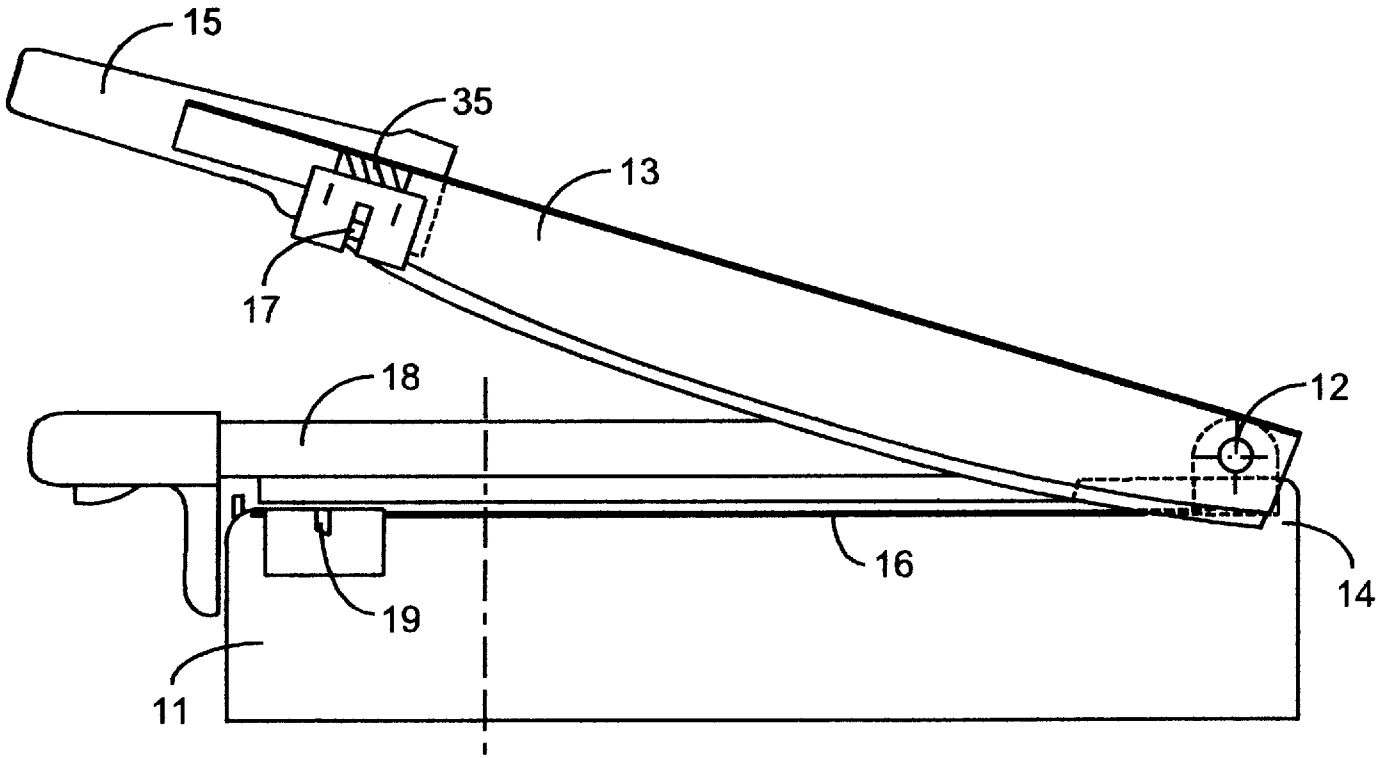
FIG. 1 is a schematic elevational view of a guillotine according to the invention, the knife-blade being represented in the raised position.

In the Figures, a frame 11 of general rectangular shape presents on its upper surface a plate 10 to support sheets to be cut. A knife-blade 13 is articulated on a spindle 12 supported by one end 14 of the frame 11 so as to move in a plane perpendicular to the plate 10 by action on an operating handle 15. The frame 11 bears a counter-blade 16 and a compression bar 18 for the sheets to be cut, which are positioned on the plate 10 at predetermined locations. The end of the longitudinal blade of the knife 13 bears a transverse blade 17, fitted flexibly and cooperating with a curved end or notch 19 of the counter-blade 16, against which it can be biased by force applied, for example, by a spring in any known manner. According to the position of the sheet with respect to the knife-blade 13, the latter cuts off a strip leaving a tab which is more or less long. The location of the sheet on the plate 10 is determined by a stop face 23 against which the edge of the sheet bears. The stop face 23 can be moved to cut tabs of different lengths.

Figure 2A:
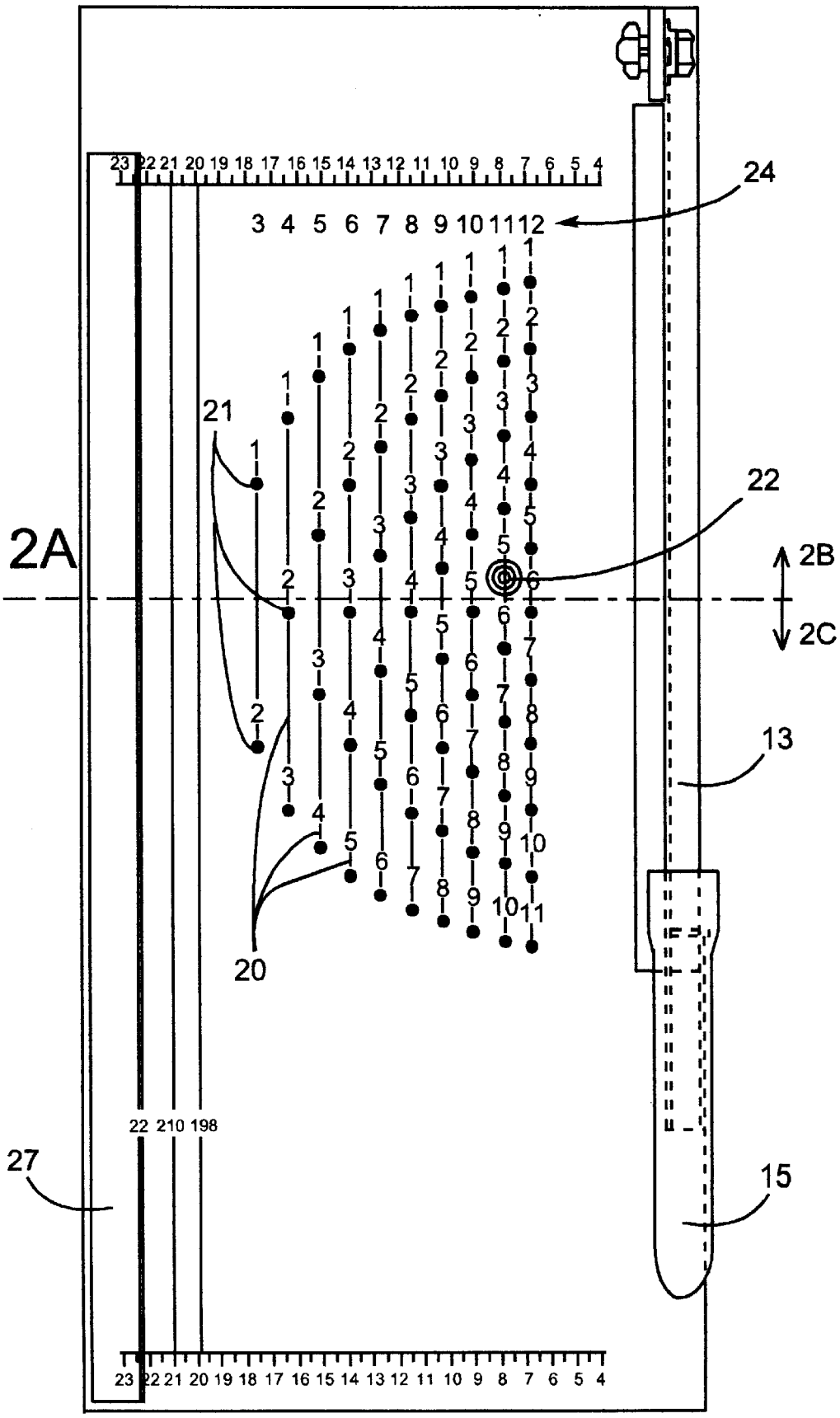
FIG. 2 is a plan view of the guillotine according to FIG. 1, the compression bar being assumed to have been removed.
Figure 2B:
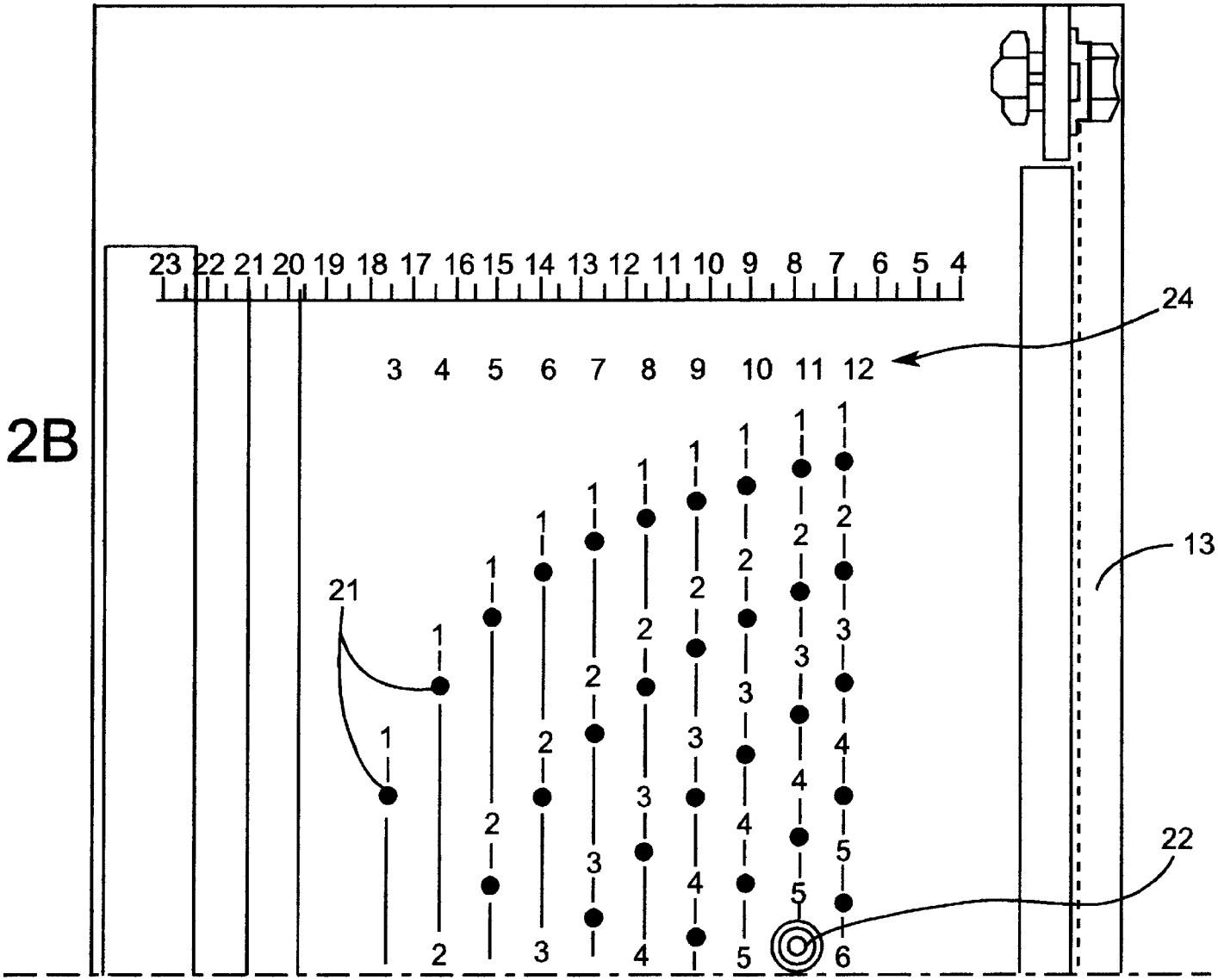
Figure 2C:
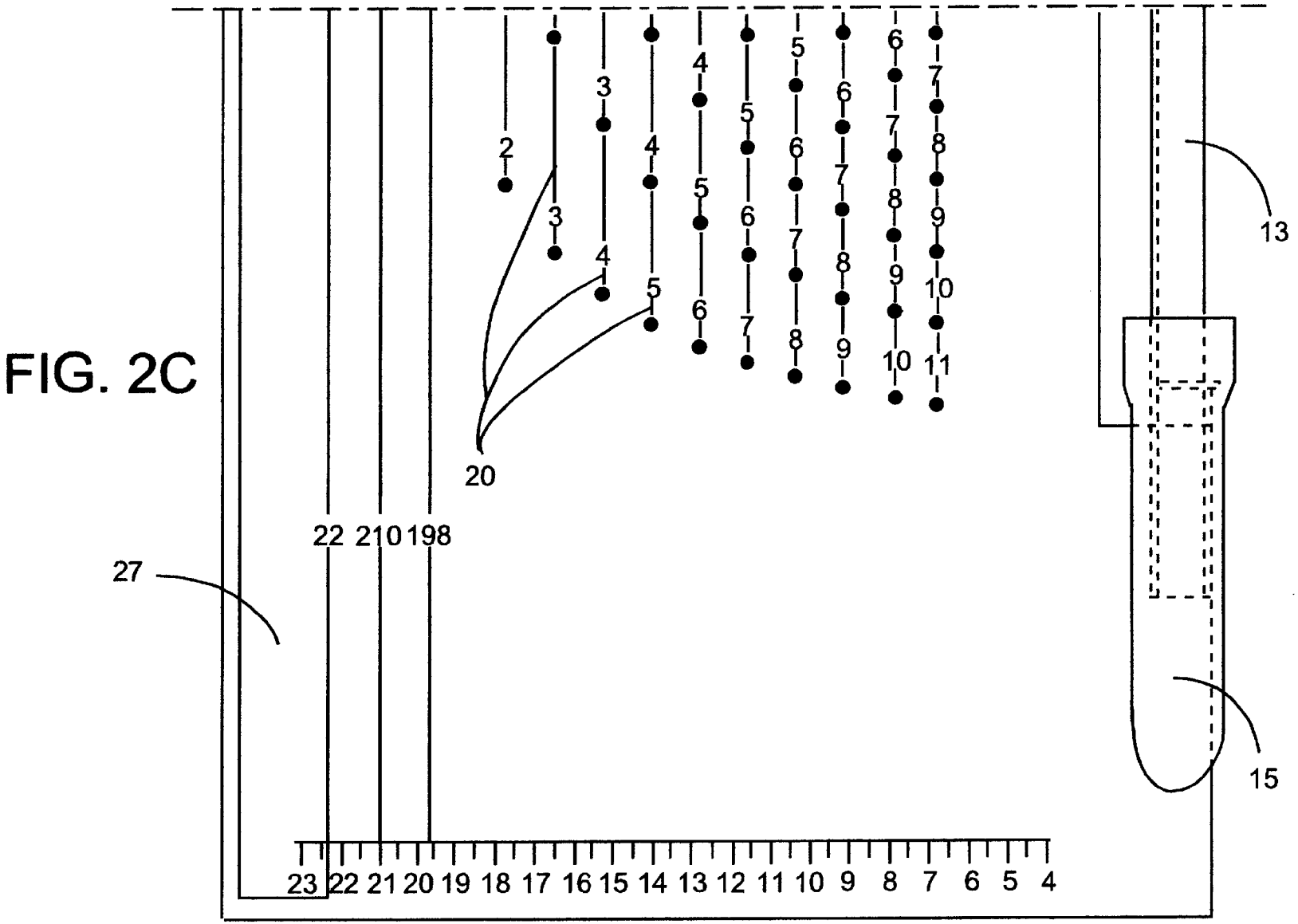
Figure 3:
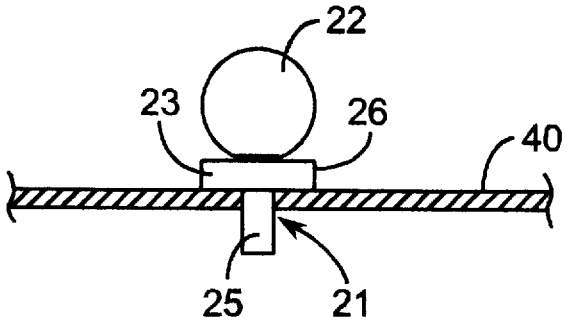
FIG. 3 is a detailed elevational view of a positioning pin.

Referring more particularly to FIGS. 2 and 3 it can be seen that the plate 10 bears lines 20 of holes 21 in which pin 22 can be inserted. Pin 22 comprises the stop face 23 for an edge of the sheet to be cut. The lines 20 are disposed side by side and parallel to the knife-blade 13 and they comprise an increasing number, per unit, of holes 21 from left to right in FIG. 2. Each line 20 is numbered at 24. The left-hand line 20, bearing the number 3, corresponds to a series of two holes 21 enabling sheets or pages of a document to be cut to achieve a brochure with three chapters. The holes 21 are arranged so as to space the different tabs regularly along the sheet, for example in the case of a sheet 29.7 cm long, respectively 9.9 and 19.8 cm from the edge of the sheet. Likewise, the adjacent line 20, corresponding to the series 4, comprises three holes 21 a 7.42 cm apart, and so on. To achieve, for example, the tabs of a brochure with three chapters, the operator chooses the line 3 and places the stop-pin 22 in the hole 21, marker 1, against which he presses the edges of the sheets of the first chapter, together or one after the other, to cut the corresponding tabs. To cut the sheets of the second chapter, he moves the stop-pin 22 to hole 21, marker 2 of this line 3 and cuts the corresponding tabs, the sheets of the third chapter remaining uncut. Any positioning error of the pin 22 and therefore any cutting errors due to equipment design are minimized and the equipment is of very simple structure.

The pin 22 comprises a centering stud 25 engaging with small clearance in the holes 21 and a collar 26 stop on the plate 10, which constitutes the bearing face 23 of The pin 22 comprises: 1) a centering stud 25 of a diameter that is slightly smaller than the holes 21 in plate 10; 2) a collar 26 having a bottom surface bearing down on the plate; and 3) a stop face 23 constituted by a lateral edge of the collar 26. The edge of the sheet to be cut is placed against the stop face 23. The collar 26 is magnetized or is itself a magnet so as to stick to the steel plate 10 and hold the pin 22 without any risk of the edge of the sheet sliding under the collar 26. Any other mode of immobilizing the pin 22 can be used.

A lateral stop rule 27, arranged parallel to and on the opposite side from the knife-blade 13, enables the width of the strip to be cut to be set. The bottom of this rule 27 is magnetized to stick perfectly to the plate 10 and its positioning is made easy by suitable marking of the plate 10.

Figure 4:
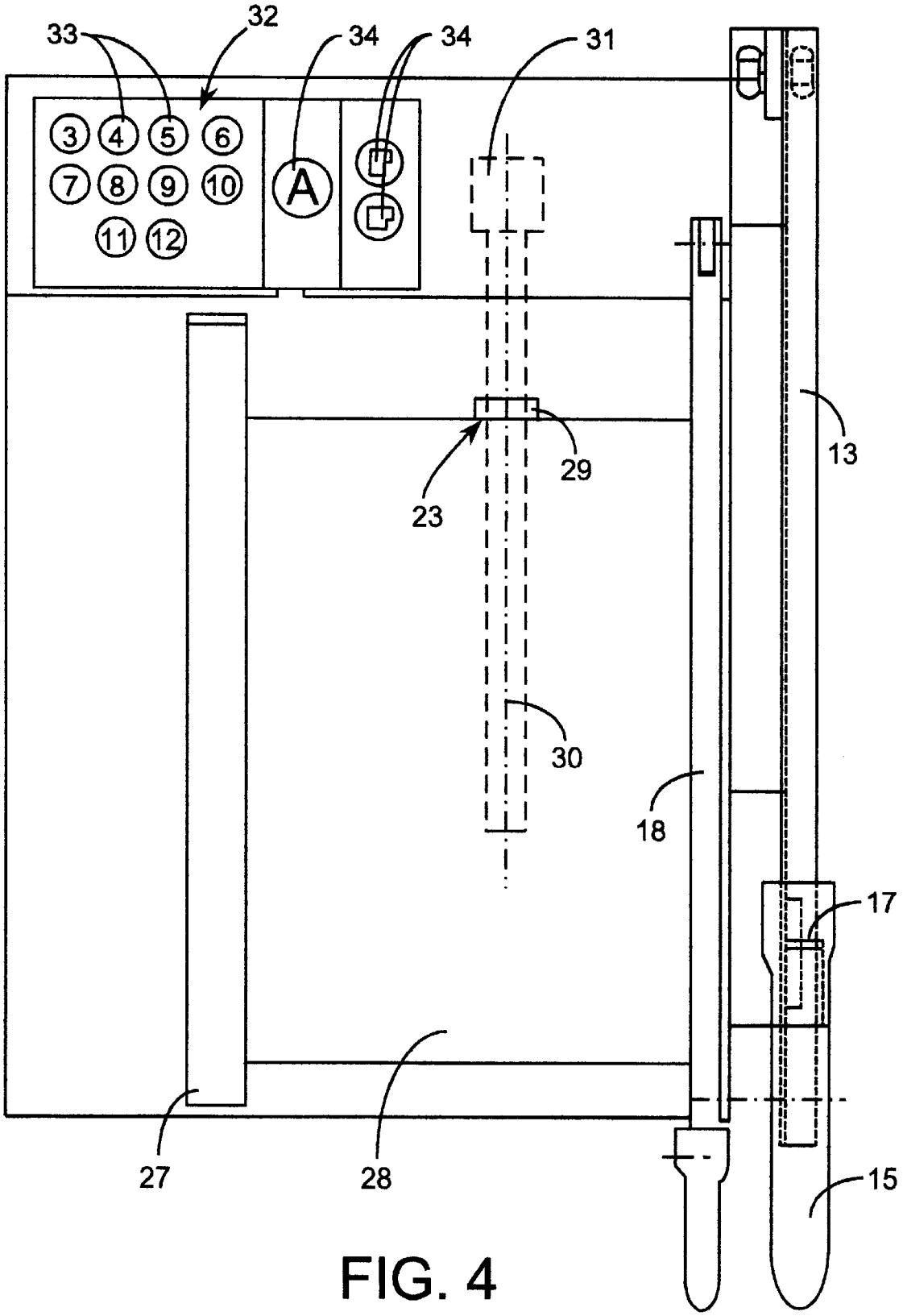
FIG. 4 is a plan view illustrating an alternative embodiment.

In FIG. 4, which illustrates an alternative embodiment, the same reference numbers designate similar or identical parts to those of FIGS. 1 to 3. The stop face 23 of the edge of the sheet 28 to be cut is abuts by a nut 29 of a screw mechanism 30 housed inside the frame 11. The screw 30 extends parallel to the knife-blade 13 and rotation of this screw 30, which is immobilized longitudinally, results in screwing of the nut 29 and a corresponding movement of the stop face 23. The screw 30 is driven in rotation by a motor 31, notably electric, controlled by a microprocessor-based control unit, having a control pad 32 which defines the cutting program. In the example represented, the pad 32 comprises keys 33 corresponding to the number of tabs to be cut to achieve the brochure, and also keys 34 corresponding to the direction in which the sheet 28 is arranged on the plate 10, i.e. widthways or lengthways. Such a movement device of a movable part for cutting tabs is described in the above-mentioned European Patent, which should be advantageously referred to for further details. Correct positioning of the sheet 28 or sheets on the plate 10 is simple and the risks of error are slight.

The invention is naturally in no way limited to the embodiments more particularly described with reference to the drawings and extends to cover any alternative embodiment remaining within the scope of equivalent embodiments.

I claim:

1. An office guillotine, comprising:

a frame having a plate;

a knife-blade having one end pivotally mounted on the frame to move in a plane perpendicular to the plate;

a counter-blade mounted on a side of the frame and cooperating with the knife-blade, at least one of the counter-blade and knife-blade having curved ends to cut a strip from, and leave a tab of a predetermined length on, any sheet of paper cut by the knife-blade and counter-blade; and a marking system disposed on the plate, the marking system including a plurality of lines extending parallel to the plane perpendicular to the plate, each of the plurality of lines indicating a different number of successive locations for positioning any sheet of paper on the plate to cut a series of regularly spaced tabs along an edge thereof, wherein a distance between any two successive locations on one of the plurality of lines is different from a distance between any two successive locations on any other of the plurality of lines.

2. The office guillotine according to claim 1, wherein the successive locations on the plate are marked to individually identify each one of the successive locations on a respective line of said plurality of lines.

3. The office guillotine according to claim 2 wherein said plurality of lines on said plate that are marked for individual identification are arranged next to one another and parallel to said knife-blade.

4. The office guillotine according to claim 1, wherein the successive locations on said plate have holes so that a pin inserted into one of the holes in said plate forms a stop cooperating with an edge of any sheet to be cut.

5. The office guillotine according to claim 4, wherein said pin comprises a magnet for keeping said pin in position on said plate.

6. The office guillotine according to claim 1, wherein the successive locations are numbered successively.

7. The office guillotine according to claim 1, wherein said knife-blade comprises a longitudinal blade and a transverse blade, said transverse blade being biased flexibly in a direction of the counter-blade.

* * * * *